United States Patent [19]

Goulet et al.

[11] Patent Number: 4,915,360

[45] Date of Patent: Apr. 10, 1990

[54] CUTTING TORCH HAVING POPPET METERED CUTTING OXYGEN FLOW CONTROL VALVE

[75] Inventors: Richard Goulet, Montreal; Tom J. Dixon, Baie D'Urfe, both of Canada

[73] Assignee: Canadian Liquid Air Ltd - Air Liquidecanada Ltee, Montreal, Canada

[21] Appl. No.: 293,078

[22] Filed: Jan. 3, 1989

[30] Foreign Application Priority Data

Jul. 13, 1988 [CA] Canada ..... 571906

[51] Int. Cl.[4] ..... B23K 7/00

[52] U.S. Cl. ..... 266/48; 239/407

[58] Field of Search ..... 266/48; 239/407, 412

[56] References Cited

U.S. PATENT DOCUMENTS

| | | | |
|---|---|---|---|
| 1,879,940 | 9/1932 | Mangiameli | 266/48 |
| 2,416,161 | 2/1947 | Deck | 266/48 |
| 4,572,483 | 2/1986 | Leu | 266/48 |

*Primary Examiner*—S. Kastler

*Attorney, Agent, or Firm*—Oblon, Spivak, McClelland, Maier & Neustadt

[57] ABSTRACT

A cutting oxygen flow control valve in a cutting torch has a poppet movably positioned in a cutting oxygen passageway upstream of a valve seat. The poppet has openings at a downstream end of the cylindrical wall thereof so that these openings are exposed upon movement of the poppet as a manually controlled diaphragm lifts off the valve seat. The progressive exposure of the openings provides for cutting oxygen flow past the valve, thereby producing a desired progression in the flow rate.

7 Claims, 3 Drawing Sheets

FLOWRATE PROGRESSION
with/without poppet (n° 4 at 50 psi)
FLOWRATE (ft³/hr)
280
260
240
220
200
180
160
140
120
100
80
60
40
20
0
POSITION OF VALVE STEM (1/32 inch increments)
□without +with poppet

CUTTING TORCH HAVING POPPET METERED CUTTING OXYGEN FLOW CONTROL VALVE

BACKGROUND OF THE INVENTION

1. Field of the Invention

The present invention relates to torches. More particularly, it relates to cutting torches, either the straight type or the attachment type, having manually operated valve mechanisms to control cutting oxygen flow rate. In a particular aspect, the invention is concerned with an improvement in cutting torches employing diaphragm type (packless) cutting oxygen valve mechanisms.

2. Background of the Related Art

Cutting torches supplying gaseous oxygen/fuel gas mixtures through cutting nozzles to produce pre-heating flame temperatures sufficiently elevated to reach the melting point of, for example, carbon steel, and also supplying commercially pure oxygen through a separate passageway to effect a cut by burning through the material, have been produced in many forms.

Conventional manually operated cutting torches have incorporated cutting oxygen valve mechanisms employing packed valve stems to seal internal regions which are pressurized with gaseous oxygen from the exterior (atmosphere). Some such packed cutting oxygen valve designs have, additionally, incorporated some type of gas flow rate metering device to enable the operator of the torch to control the flow rate of gaseous oxygen through the cutting oxygen valve and nozzle by selective positioning of the valve operating mechanism. Such cutting oxygen flow rate control is desirable in order to facilitate performance of the cutting process while improving the quality and the precision of the resulting cut.

Cutting torches of the packed stem cutting oxygen valve type present certain difficulties and inconveniences which are inherent in the packed stem design. Each actuation of the cutting oxygen valve mechanism effects a linear axial displacement of the valve stem relative to the torch body and stem packing. Such axial displacement, both on opening and on closing the valve, produces abrasive wear of the stem packing. This eventually results in gas leakage past the packing, from the internal pressurized region to the exterior. Such gaseous oxygen leakage is hazardous due to the resulting oxygen enrichment of the immediate vicinity, which greatly increases the potential for damage or injury should any combustible material be ignited.

A preferred design of a cutting oxygen valve for cutting torches is the diaphragm (packless) type. Such valves incorporate no stem packing and thus are not subject to the inconvenience and hazard of leaking gaseous oxygen. However, a deficiency of the diaphragm type cutting oxygen valves used prior to the present invention has been their inability to produce a controlled gaseous cutting oxygen flow rate proportional to the axial displacement of the valve stem when selectively positioned by the user of the torch. The actual flow rate obtained on actuation of the cutting oxygen valve operating mechanisms of previous cutting torches of the diaphragm type has been virtually the maximum flow rate attainable for the gas pressures and orifice sections employed. Little throttling effect, if any, has been produced.

Thus the prior art has not provided a totally satisfactory design of a cutting torch.

SUMMARY OF THE INVENTION

It is therefore an object of the present invention to overcome the above deficiencies and to provide a cutting torch which permits the user to control the cutting oxygen flow rate through the torch by selective positioning of the cutting oxygen valve operating mechanism, thereby facilitating the achievement of high cutting and piercing, all the while retaining the security provided by the diaphragm (packless) type of cutting oxygen valve.

According to the invention, a cutting oxygen flow control valve is provided in a cutting torch. The cutting torch includes a cutting head connected to an oxygen inlet passageway via a cutting oxygen passageway and a combustion oxygen flow control valve having a combustion oxygen passageway connected to the oxygen inlet passageway for metering oxygen for combustion with a fuel gas in the cutting head. The cutting oxygen flow control valve is a manually operated valve positioned in the cutting oxygen passageway downstream of a point where the combustion oxygen passageway connects to the oxygen inlet passageway in an oxygen flow direction. It includes means for defining a valve seat in the cutting oxygen passageway, a diaphragm positionable in the cutting oxygen passageway for seating on the valve seat to close the cutting oxygen passageway, biasing means for pressing on the diaphragm for seating on the valve seat in opposition to the cutting oxygen gas pressure in the cutting oxygen passageway, manual means for reducing a pressure of the biasing means on the diaphragm whereby cutting oxygen gas pressure can lift the diaphragm from the seat to open the cutting oxygen passageway, and a poppet movably positioned in the cutting oxygen passageway upstream of the valve seat, the poppet having orifice means for varying a passage area of the cutting oxygen passageway as a function of a position of the poppet in the cutting oxygen passageway, such that the sectional area increases with downstream movement of the poppet. The poppet is moved downstream by cutting oxygen gas pressure to increase the sectional area as the manual means lifts the diaphragm from the seat so that the flow rate of oxygen past the valve is substantially proportional to the lifting of the diaphragm from the seat.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
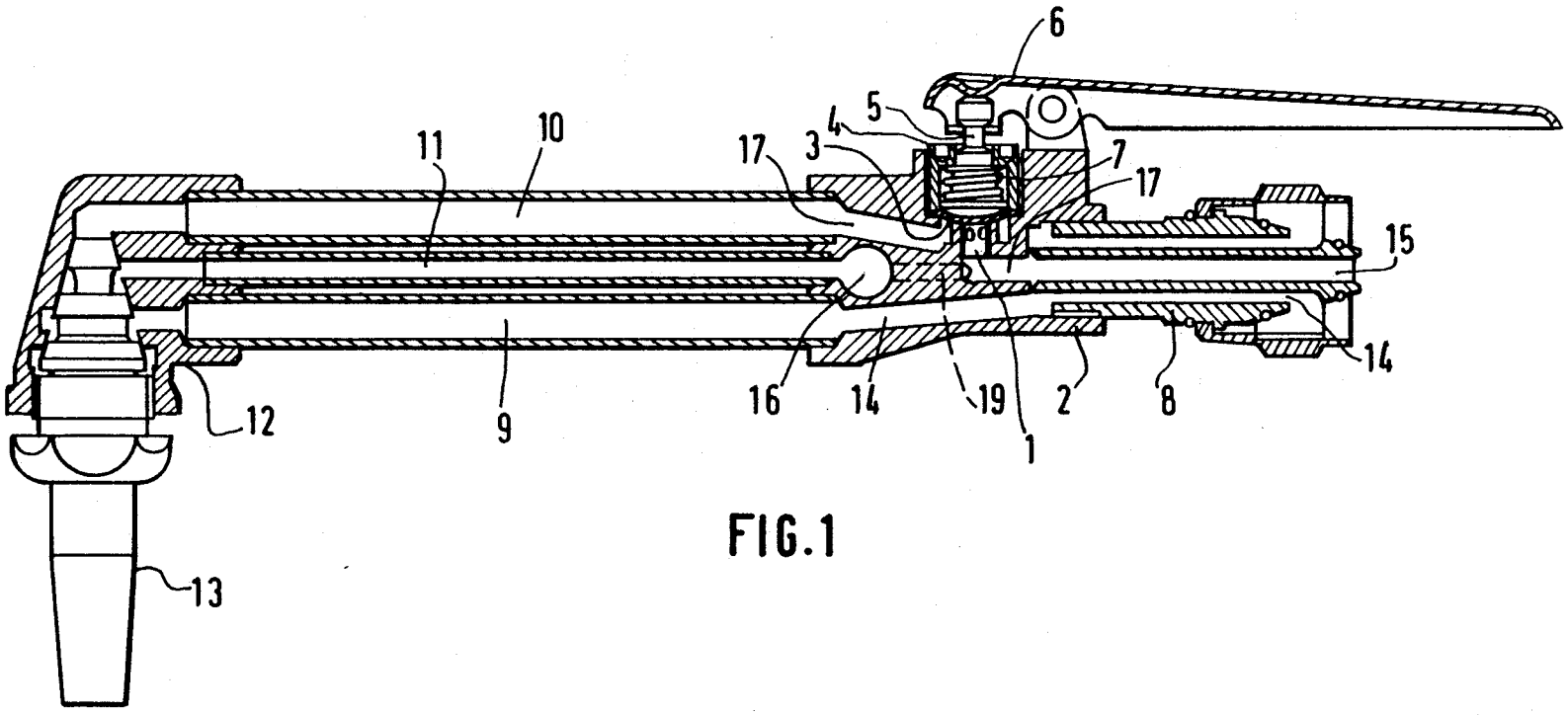
FIG. 1 is a side elevation, partly in section, of one embodiment of the invention.

In accordance with the invention, there is provided a cutting torch, either the straight type or the attachment type, that can employ any of the welding or heating fuel gases and gaseous oxygen. The torch has a torch head 12 and a torch nozzle 13 connected in fluid tight relationship with said torch head. A torch body 2 has a fuel gas inlet passageway 14 and an oxygen inlet passageway 15. A fuel gas flow control valve (not shown) is sealingly connected with the fuel gas inlet passageway and a combustion oxygen flow control valve 16 having a combustion oxygen passageway 19 is sealingly connected with the inlet passageway 15 for metering the oxygen to be mixed with the fuel gas in the torch nozzle 13 for subsequent combustion. A cutting oxygen passageway 17 is connected with said oxygen inlet passageway 15 downstream of the point where the combustion oxygen passageway 19 connects with the oxygen inlet passageway 15. A cutting oxygen tube 10 is sealingly connected with said cutting oxygen passageway 17 and a fuel tube 9 is sealingly connected with said fuel gas passageway 14. A combustion oxygen tube 11 is sealingly connected with said oxygen flow control valve 16.

A cutting oxygen flow control valve is sealingly disposed in the cutting oxygen passageway 17 and includes a valve operator 6 linked mechanically to a cutting oxygen valve stem 5 by a flange **6*a* which hooks under head 5*a* of the stem such that pivoting of the operator about pivot 6*b* lifts the stem. The cutting oxygen valve stem 5 is external to the cutting oxygen passageway 17 and is separated from said cutting oxygen passageway by a sealing diaphragm 3. The diaphragm 3 is both a pressure barrier and seal between said cutting oxygen passageway 17 and the exterior, and a seal within the cutting oxygen passageway 17 for pressing against a cutting oxygen valve seat 18. The diaphragm 3 is normally in contact with said cutting oxygen valve seat 18 and is so held by the head 5*b* of said cutting oxygen valve stem under the force of biasing means in the form of a compression spring 7, said compression spring being compressed against the head 5*b* of said cutting oxygen valve stem by a retaining screw 4 threaded into the torch body 2**. The retaining screw sealingly presses the edges of the diaphragm to the torch body.

Figure 3:
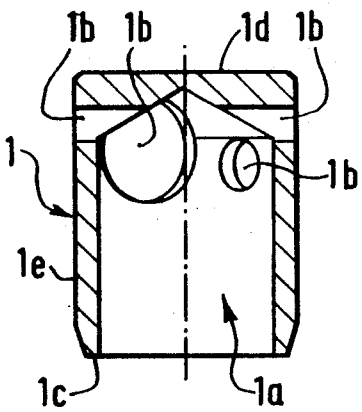
FIG. 3 is an elevation of the embodiment of the cutting oxygen flow metering poppet of FIG. 2.
Figure 2:
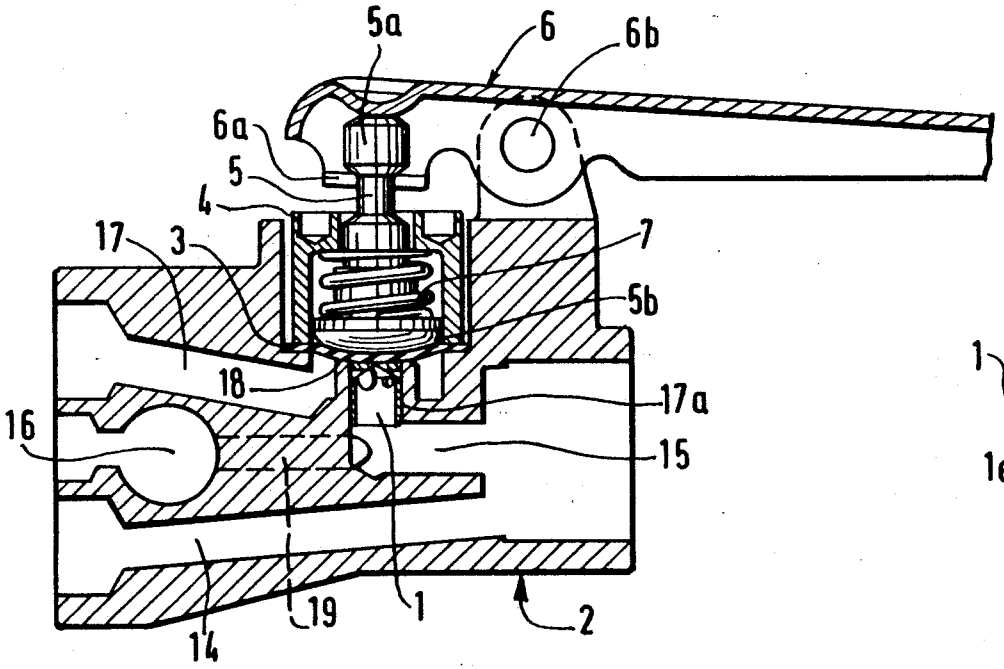
FIG. 2 is an enlarged section through the cutting oxygen valve of the embodiment of FIG. 1.

As seen in FIGS. 2 and 3, a cutting oxygen flow metering poppet 1 is slidably held within said cutting oxygen passageway, upstream of the seal between said diaphragm 3 and said cutting oxygen valve seat 18. The cutting oxygen flow metering poppet 1 has a cylindrical form so as to locate it concentrically within a cylindrical portion **17*a* of said cutting oxygen passageway 17 and has one open end 1*c*, at its upstream end, and a closed end 1*d*, at its downstream end. The cutting oxygen flow metering poppet has an internal bore 1*a* for passage of cutting oxygen from the oxygen inlet passageway 15 to said cutting oxygen tube 10 via orifice means in the form of openings 1*b* disposed around the circumference of the cylindrical wall 1*e* of the poppet adjacent the closed end 1*d*. The cutting oxygen flow metering poppet is floatingly in contact with said diaphragm 3, supported by the pressure of cutting oxygen fluid flow and freely disposed to move axially within said cutting oxygen passageway 17 to the extent of the axial displacement of said cutting oxygen valve stem 5, thereby exposing a greater or lesser area of said openings 1*b* for cutting oxygen flow therepast. The cutting oxygen flow metering poppet has said openings 1*b* in such number, form and disposition that the combined opening area of said openings exposed for cutting oxygen flow determines the sectional area of the cutting oxygen passageway and so the flow rate attained at any particular extent of axial displacement of valve stem 5. For example, in the embodiment of FIG. 3, three sets of different size opposed openings 1*b* are formed in the cylindrical surface of the poppet 1**, for a total of six openings (only four such openings are shown).

In use, the spring 7 normally causes the head **5*b* of the stem 5 to press against the diaphragm, and thereby seal the diaphragm against the seat 18 so that the cutting oxygen passageway 17 is closed. Combustion oxygen for mixing with the fuel gas can still be metered by the valve 16** for delivery to the cutting head.

Once manual pressure on the valve operator 6 causes it to pivot in the clockwise direction (FIGURE 2), the engagement of the flange **6*a* with the head 5*a* of the cutting oxygen valve stem 5 raises the stem 5 against the force of the spring 7, so that the stem head 5*b* no longer presses the diaphragm 3 against the seat 18. Gas pressure within the cutting oxygen passageway 17 will then force the poppet 1 upward to help lift the diaphragm 3 from the seat 18. As the poppet rises past the seat 18, the sectional areas of the openings 1*b*** are progressively opened so that cutting oxygen can pass downstream of the cutting oxygen flow control valve.

Figure 4:
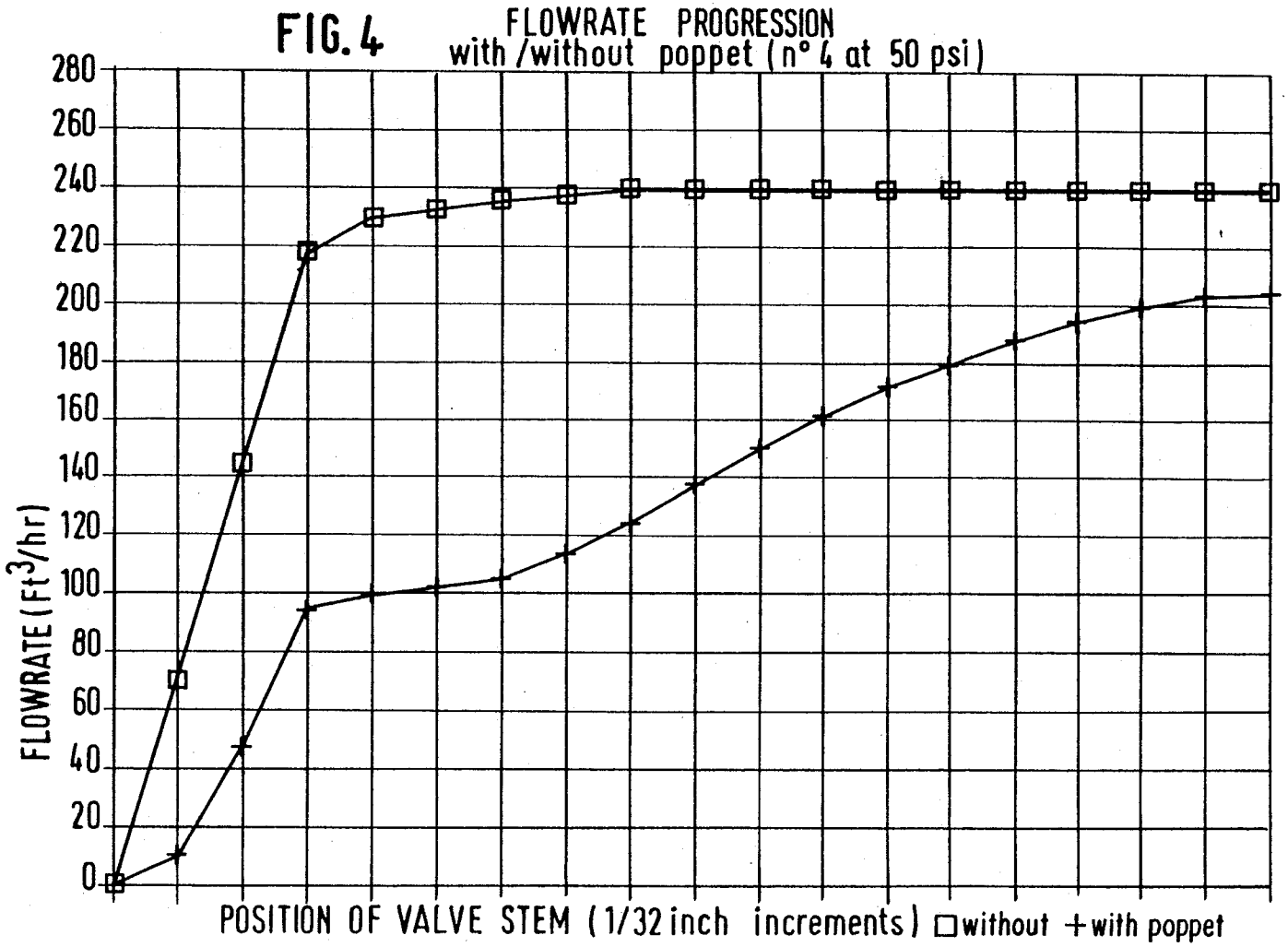
FIG. 4 is a graph showing the cutting oxygen flow rate progression as a function of linear axial displacement of the cutting oxygen flow metering poppet of FIG. 3.

By selectively sizing and positioning the openings **1*b*, one can produce any desired predetermined relationship between the degree of movement of the valve operator 6 (and so the position of the valve stem 5) and the cutting oxygen flow rate. An example is shown in FIG. 4 which shows the flow rate (in cubic feet per hour) past a cutting oxygen flow control valve, both with and without a poppet. The poppet in FIG. 4 is no. 4** caliber and the gas pressure is 50 psig. The line having data points designated by squares represents the valve without the poppet. As can be seen, there is a rapid increase in flow rate for initial movements of the valve stem, followed by a substantially constant flow rate during the remainder of the valve stem movement. In contrast, the same cutting oxygen flow control valve with the poppet (line having data points marked by crosses) produced a fairly linear, i.e., substantial proportional, progression of increased flow rates with increased amounts of movement of the valve stem and of the diaphragm that moves therewith.

Obviously, numerous modifications and variations of the present invention are possible in light of the above teachings. It is therefore to be understood that within the scope of the appended claims, the invention may be practiced otherwise than as specifically described herein.

WHAT IS CLAIMED AS NEW AND DESIRED TO BE SECURED BY LETTERS PATENT OF THE UNITED STATES IS:

1. In a cutting torch having a cutting head connected to an oxygen inlet passageway via a cutting oxygen passageway and a combustion oxygen flow control valve having a combustion oxygen passageway connected to said oxygen inlet passageway for metering oxygen for combustion with a fuel gas in the cutting head, a manually operated cutting oxygen flow control valve positioned in said cutting oxygen passageway downstream of a point where said combustion oxygen passageway connects to the oxygen inlet passageway in an oxygen flow direction, said cutting oxygen flow control valve comprising:

means for defining a valve seat in said cutting oxygen passageway;

a diaphragm positionable in said cutting oxygen passageway and normally seated on said valve seat to close said cutting oxygen passageway;

manual means for selectively lifting said diaphragm from said valve seat to open said cutting oxygen passageway; and a poppet movably positioned in said cutting oxygen passageway upstream of said valve seat, said poppet having orifice means for varying a passage area of said cutting oxygen passageway as a function of a position of said poppet in said cutting oxygen passageway such that said sectional area increases with downstream movement of said poppet, whereby said poppet is moved downstream by cutting oxygen gas pressure to increase said sectional area as said manual means for selectively lifting lifts said diaphragm from said seat, so that a flow rate of oxygen past said oxygen flow control valve is substantially proportional to a lifting of said diaphragm from said seat.

2. The cutting torch of claim 1 including biasing means for pressing on said diaphragm for seating on said valve seat in opposition to cutting oxygen gas pressure in said cutting oxygen passageway, wherein said manual means for selectively lifting comprise manual means for reducing a pressure of said biasing means on said diaphragm whereby cutting oxygen gas pressure can lift said diaphragm from said seat to open said cutting oxygen passageway.

3. The cutting torch of claim 1 wherein said poppet valve is positioned in a cylindrical portion of said cutting oxygen passageway adjacent said seat and wherein said poppet comprises a cylinder closely fitted in said cylindrical portion and having a closed downstream end, said orifice means comprising at least one opening in the cylindrical wall of said poppet adjacent said closed end, whereby said at least one opening is progressively opened as said cylindrical wall of said poppet moves past said seat and out of said cylindrical portion as said diaphragm lifts from said seat.

4. The cutting torch of claim 3 including at least two of said openings of different sizes.

5. The cutting torch of claim 2 wherein said manual means for reducing a pressure of said biasing means comprise:

a valve stem pressed by said biasing means against said diaphragm; and a manual valve operator having means for lifting said valve stem from said diaphragm.

6. The cutting torch of claim 3 wherein said manual means comprises:

a valve stem pressed by said biasing means against said diaphragm; and a manual valve operator having means for lifting said valve stem from said diaphragm.

7. The cutting torch of claim 6 wherein said biasing means is a spring.

* * * * *